US006703717B2

(12) United States Patent
Kawamoto et al.

(10) Patent No.: US 6,703,717 B2
(45) Date of Patent: Mar. 9, 2004

(54) STARTER DEVICE FOR A FOUR WHEELED ALL TERRAIN VEHICLE AND STRADDLE-TYPE FOUR WHEELED ALL TERRAIN VEHICLE COMPRISING THE SAME

(75) Inventors: Yuichi Kawamoto, Akashi (JP); Kazuhiro Maeda, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 153 days.

(21) Appl. No.: 10/099,078

(22) Filed: Mar. 13, 2002

(65) Prior Publication Data

US 2002/0134606 A1 Sep. 26, 2002

(30) Foreign Application Priority Data

Mar. 26, 2001 (JP) ..... 2001-088040

(51) Int. Cl.[7] ..... F02N 11/00
(52) U.S. Cl. ..... 290/38 R; 290/38 E
(58) Field of Search ..... 290/38 R, 38 E, 290/48; 180/287, 271

(56) References Cited

U.S. PATENT DOCUMENTS 3,009,067 A * 11/1961 Janeczko et al. ..... 290/38 A
4,074,226 A * 2/1978 Takeda et al. ..... 340/452
4,414,937 A * 11/1983 Ueda et al. ..... 123/198 D
4,415,812 A * 11/1983 Griffith et al. ..... 290/38 R
4,436,176 A * 3/1984 Cota et al. ..... 180/287
4,481,425 A * 11/1984 Hori et al. ..... 290/51
4,590,385 A * 5/1986 Hamano et al. ..... 290/38 E
5,065,135 A * 11/1991 Leigh-Monstevens et al. ..... 340/463
2001/0040060 A1 * 11/2001 Morimoto et al. ..... 180/65.3

FOREIGN PATENT DOCUMENTS

JP 61-167166 7/1986

* cited by examiner

*Primary Examiner*—Nicholas Ponomarenko
(74) *Attorney, Agent, or Firm*—Kolisch Hartwell, P.C.

(57) ABSTRACT

Disclosed are a highly-reliable starter device of a four-wheeled all terrain vehicle (ATV), reliably functioning corresponding switches even when a brake or neutral lamp is burned. This device is suitable to the straddle-type ATV provided with a transmission lever at a position different from the steering handle and provided with the starter switch in the vicinity of the handle grip. A drive circuit for connecting a starter motor for driving the engine to a power supply. In addition, two relays are connected in parallel to the starter circuit connecting a start relay to the power supply through the starter switch, and a brake switch and a neutral switch are connected in parallel with each other between the starter circuit and the ground. When each of the switches is closed, the corresponding relay is operated to close the starter circuit.

6 Claims, 4 Drawing Sheets

STARTER DEVICE FOR A FOUR WHEELED ALL TERRAIN VEHICLE AND STRADDLE-TYPE FOUR WHEELED ALL TERRAIN VEHICLE COMPRISING THE SAME

BACKGROUND OF THE INVENTION

1. Field of the Invention

The present invention relates to a starter device for a four-wheeled all terrain vehicle that is capable of operating a starter motor to start an engine regardless whether a transmission gear is at a neutral position or a brake is being operated, and a straddle-type four wheeled all terrain vehicle comprising the starter device.

2. Description of the Related Art

Since four-wheeled all terrain vehicles (ATVs) are capable of stably traveling over sandy soil, rough terrain, and wet terrain, and carrying a great deal of luggage and equipment, they are utilized in various uses including leisure, sport activities, field work, etc.

Among four wheeled all terrain vehicles, many straddle-type four wheeled all terrain vehicles are equipped with bar-type steering handles as in the case of motorcycles. A rider grips the steering handle with both hands and operates a throttle lever provided on the steering handle to control engine speed. Also, in recent years, with diversification of users, automatic all terrain vehicles with belt converters have been put on the market. The automatic all terrain vehicle is provided with a transmission lever on the vehicle's body in the vicinity of the steering handle. By operation of the transmission lever, switching among "L (low speed)", "H (high speed)", "N(neutral)", and "R (reverse)", can be carried out.

In the above-described straddle-type four wheeled all terrain vehicle, when an engine of the vehicle stalls during traveling or stopping, the rider turns on a starter switch for re-starting. Conventionally, in this type of all terrain vehicle, the starter motor is not energized even if the starter switch is turned on, unless the transmission lever is returned to its neutral position prior to the start operation.

Accordingly, in the above constitution, the rider needs to return the transmission lever to its neutral position in every re-start and therefore its operation is burdensome. As an improvement of this, Publication of (Unexamined) Japanese Patent Application No. Showa 61-167166, discloses a starter device, in which a starter motor is energized when a starter switch is turned on, by operation of a brake instead of returning a transmission lever to its neutral position.

The starter device in FIG. 1 includes a drive circuit and a starter circuit. In the drive circuit, a starter motor M for driving the engine is connected to a power supply PS through a contact 3*a* of a start relay 3. In the starter circuit, a coil portion 3*b* of the start relay 3 is connected to the power supply PS through a contact 5*a* of a start check relay 5 and a starter switch 6. A neutral switch 9 is connected to a coil portion 5*b* of the start check relay 5 through a diode 8, and a brake switch 10 is connected in parallel with the neutral switch 9.

When the transmission gear is placed at the neutral position, the neutral switch 9 is responsively closed to cause the neutral lamp 11 to be lighted up. Under the condition, when the starter switch 6 is closed, an excitation current flows through the coil portion 5*b* of the start check relay 5 to cause the contact 5*a* to be closed.

Meanwhile, the brake switch 10 is closed according to a brake operation. In association with the brake switch 10, a contact 12 is closed to cause a brake lamp 13 to be lighted up. Under the condition, when the starter switch 6 is closed in the same manner, the excitation current flows through the coil portion 5*b* of the start check relay 5, thereby closing the contact 5*a*. At this time, since the current flowing from the side of the neutral switch 9 toward the brake switch 10 is blocked by the diode 8, the neutral lamp 11 is not lighted up when the brake switch 10 is closed.

In the configuration of this disclosure, the brake switch 10 is provided between the neutral switch 9 and the starter circuit so as to be in parallel with the neutral switch 9. Therefore, when one of the neutral switch 9 and the brake switch 10 is closed, the start check relay 5 is closed, in which state, when the starter switch 6 is closed, the start relay 3 is closed to cause the starter motor M to be connected to the power supply PS, thus starting the engine.

However, in the above-identified conventional starter device, for the purpose of reliable functioning of the brake switch 10 even in the case of the burning out of the brake lamp 13 in which a heating element in a light bulb is disconnected and a circuit is open, the brake lamp 13 is not connected in series to the brake switch 10. Instead, the brake lamp 13 is connected in parallel to the brake switch 10 and the contact 12 operating in association with the brake switch 10 is provided in series with the brake lamp 13. For this reason, in order to light up the brake lamp 13 and close the starter circuit, two contacts, i.e., the brake switch 10 and the contact 12, are needed.

SUMMARY OF THE INVENTION

The present invention addresses the above-described conditions and an object of the present invention is to provide a starter device of a four wheeled all terrain vehicle which includes a switch that reliably functions even when a brake lamp or a neutral lamp has burned out, and which, when lighting up a brake lamp and/or closing a starter circuit, does not need two contacts, as well as a straddle-type four wheeled all terrain vehicle comprising the same.

To address the above-described conditions, there is provided a starter device of a four wheeled all terrain vehicle, in which a drive circuit for connecting a starter motor for driving the engine to a power supply, a start relay, a starter circuit for connecting the start relay to the power supply through a starter switch, a first relay, a neutral switch is provided between the starter circuit and a ground, and a brake switch is provided between the starter circuit and the ground so as to be in parallel with the neutral switch, and a second relay is provided in parallel with the first relay and in series with the neutral switch, and the starter motor is energized:

by at least either one of responsively closing the neutral switch to cause the neutral lamp connected to the power supply to be lighted up and to cause the second relay to be closed, when a transmission lever of the vehicle is operated to cause the transmission to be at a neutral position, and responsively closing the brake switch to cause the brake lamp connected to the power supply to be lighted up and to cause the first relay to be closed, when the brake of the vehicle is operated, and when the starter switch is operated to be closed to cause the start relay to be responsively closed.

In this configuration, two relays are connected in parallel to the starter circuit, while the brake switch and the neutral switch are connected in parallel between the starter circuit and the ground. By closing each of the switches, the corresponding relay is operated to close the starter circuit. Accordingly, it is possible to attain a highly-reliable starter device of the four wheeled all terrain vehicle which is capable of lighting up the brake lamp and closing the starter circuit without a need for two contacts, i.e., the brake switch 10 and the contact 12. It should be noted that the starter device of the present invention is applicable to four wheeled all terrain vehicles of any other types.

It is preferable that in the starter device, the brake lamp is provided in parallel with the first relay and in series with the brake switch. Thereby, even if the brake lamp has burned out, the corresponding brake switch can function reliably.

It is preferable that in the starter device, the neutral lamp is provided in parallel with the second relay and in series with the neutral switch. Thereby, even if the neutral lamp has burned out, the corresponding neutral switch can function reliably.

Further, it is preferable that the starter device is mounted in a straddle-type four wheeled all terrain vehicle, in which a transmission lever is provided at a position of the vehicle's body that is different from the position at which the steering handle having a grip is provided, for operating in association with the neutral switch, the starter switch is provided in the vicinity of the grip of the steering handle, and a brake operating means is adapted to operate in association with the brake switch. Thereby, since even in the case of engine stalling, the rider is capable of easily re-starting the engine while gripping the steering handle, the starter device of the present invention is well suitable to the straddle-type four wheeled all terrain vehicle which often travels over sandy soils, rough terrain, and wet terrain.

The above and further objects and features of the invention will more fully be apparent from the foregoing description with accompanying drawings.

DETAILED DESCRIPTION OF THE PREFERRED EMBODIMENTS

Hereinafter, an embodiment of a four wheeled all terrain vehicle according to the present invention will be described. By way of example, a straddle-type four wheeled all terrain vehicle will be described in detail with reference to accompanying drawings.

Figure 1:
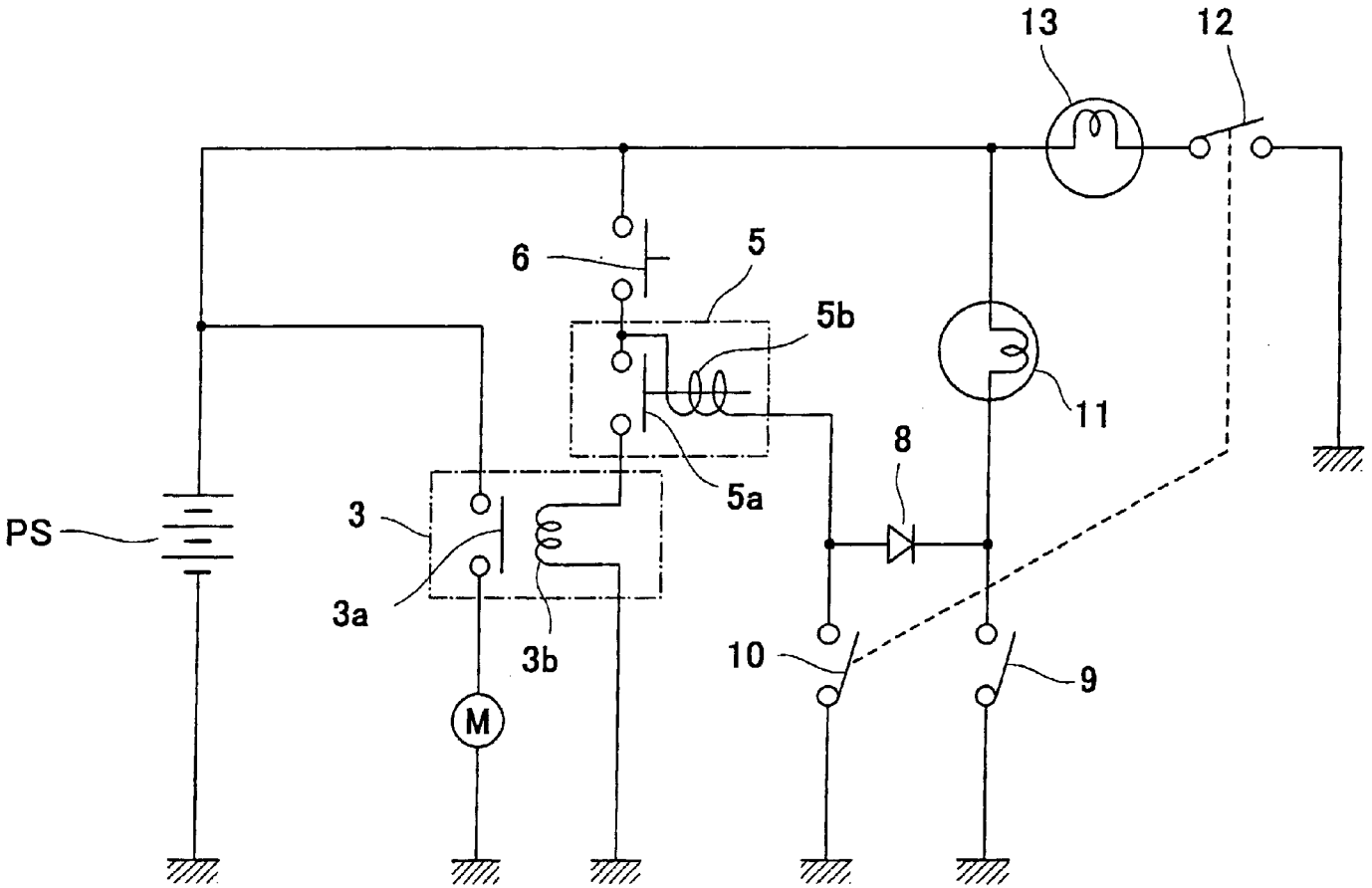
FIG. 1 is a circuit diagram showing a constitution of the conventional starter device.
Figure 2:
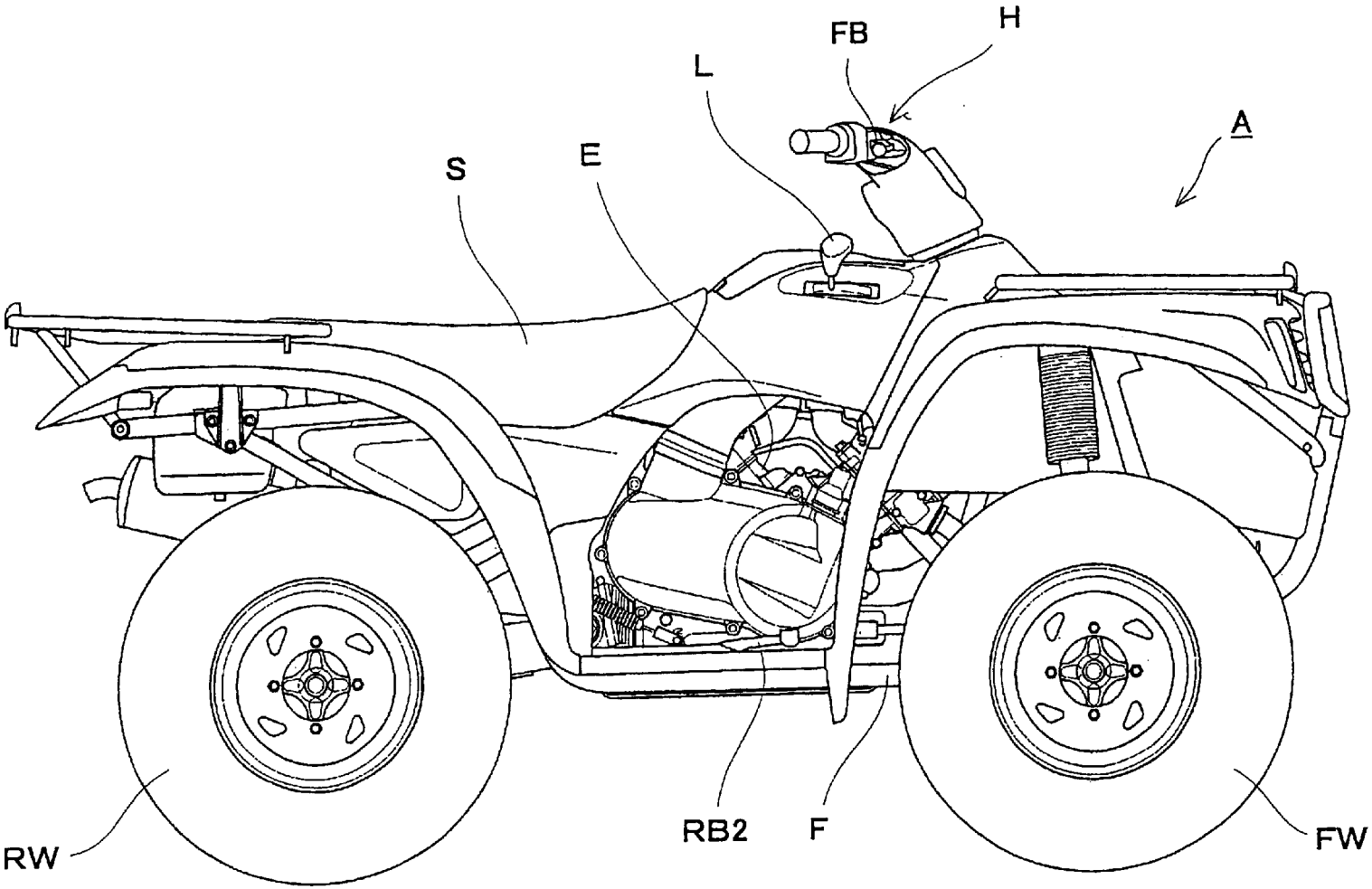
FIG. 2 is a side view showing an entire constitution of a straddle-type four wheeled all terrain vehicle according to the present invention.
Figure 3:
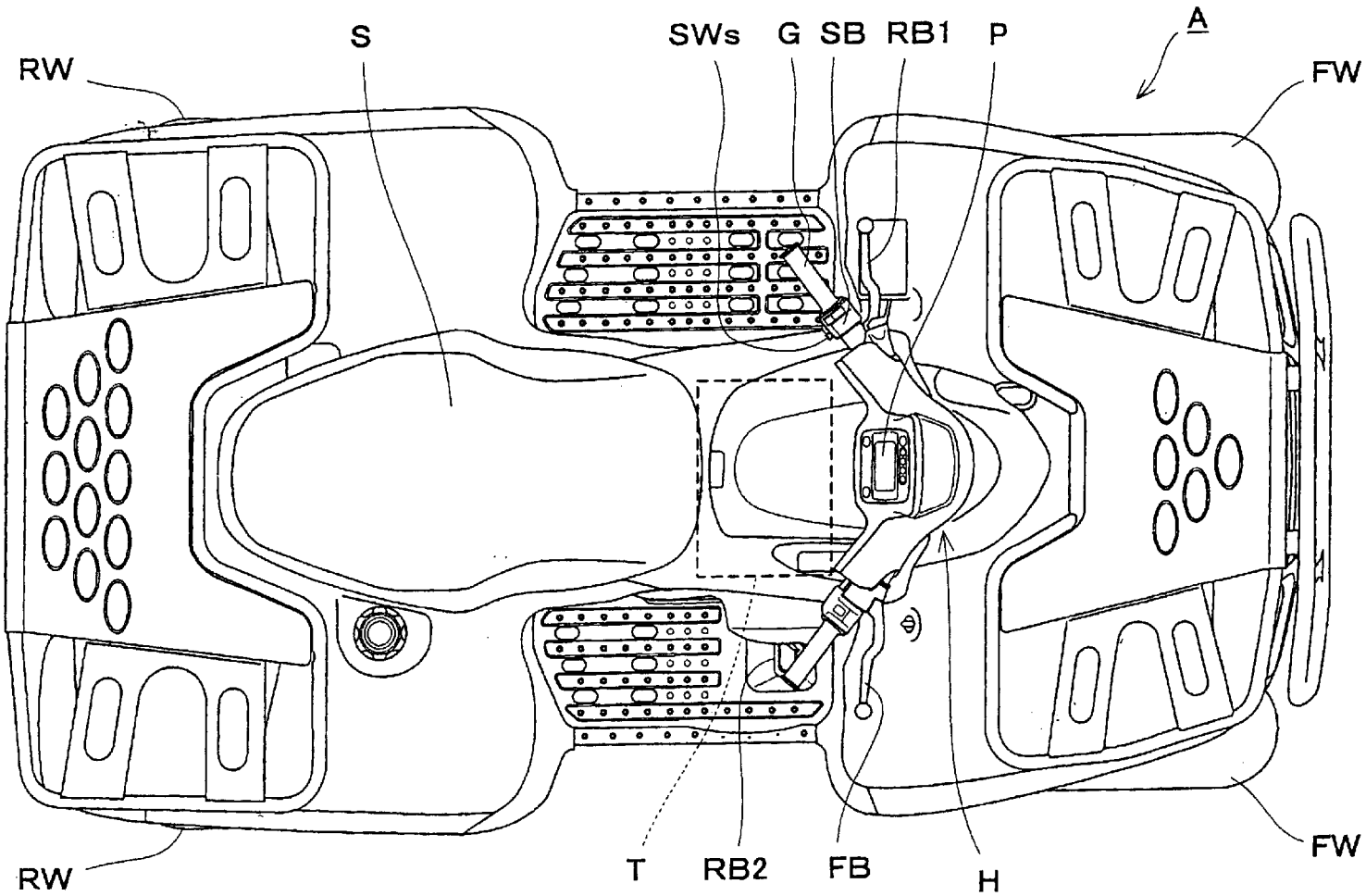
FIG. 3 is a plan view showing the entire straddle-type four wheeled all terrain vehicle of FIG. 2.

FIG. 2 is a side view showing the entire constitution of the straddle-type four wheeled all terrain vehicle according to this embodiment, and FIG. 3 is a plan view showing the entire straddle-type four wheeled all terrain vehicle of FIG. 2. Referring to FIGS. 2, 3, an all terrain vehicle A of this embodiment is provided with an engine E mounted at a central portion of a vehicle's body frame Fr comprised of a pipe member. A steering column (not shown) is rotatably supported at a front portion of the frame Fr so as to extend substantially vertically at a suitable caster angle. An upper end of the steering column is fixed to a bar-type steering handle H and a lower portion of the steering column is connected to front wheels FW for steering suspended from right and left sides of a front lower portion of the frame Fr by means of a pair of tie rods (not shown).

A rider straddles the straddle-type seat S mounted to a rear upper portion of the frame Fr, and grips and rotates the steering handle H around the steering column to steer the front wheels FW to the right or to the left.

Rear wheels RW having a common axle are suspended from right and left sides of a rear portion of the frame Fr and are driven by the engine E through a transmission gear T (see FIG. 3). The all terrain vehicle A of this embodiment comprises a gearless transmission of a belt converter type, so-called "CVT (Continuously Variable Transmission)".

A transmission lever L is provided on a vehicle's body in the vicinity of the steering handle H. The rider can operate the transmission lever L to switch the transmission gear T to any of "L (low speed)", "H (high speed)", and "R (reverse)". When the transmission lever L is at "N(neutral) position", a neutral lamp Ln (see FIG. 4) mounted in an indicator panel P of FIG. 3 is lighted up.

The steering handle H is provided with a brake lever FB at a right end thereof, for operating a brake (not shown) of the front wheels FW and a brake lever RB1 at a left end thereof, for operating a brake (not shown) of the rear wheels RW. The brake of the rear wheels RW can be operated in the same manner by a foot brake RB2 provided on the right side of the vehicle's body. When the brake levers FB, RB1 are respectively operated by a given amount or more, a brake lamp Lb (see FIG. 4) mounted in a rear portion of the vehicle's body is lighted up.

Figure 4:
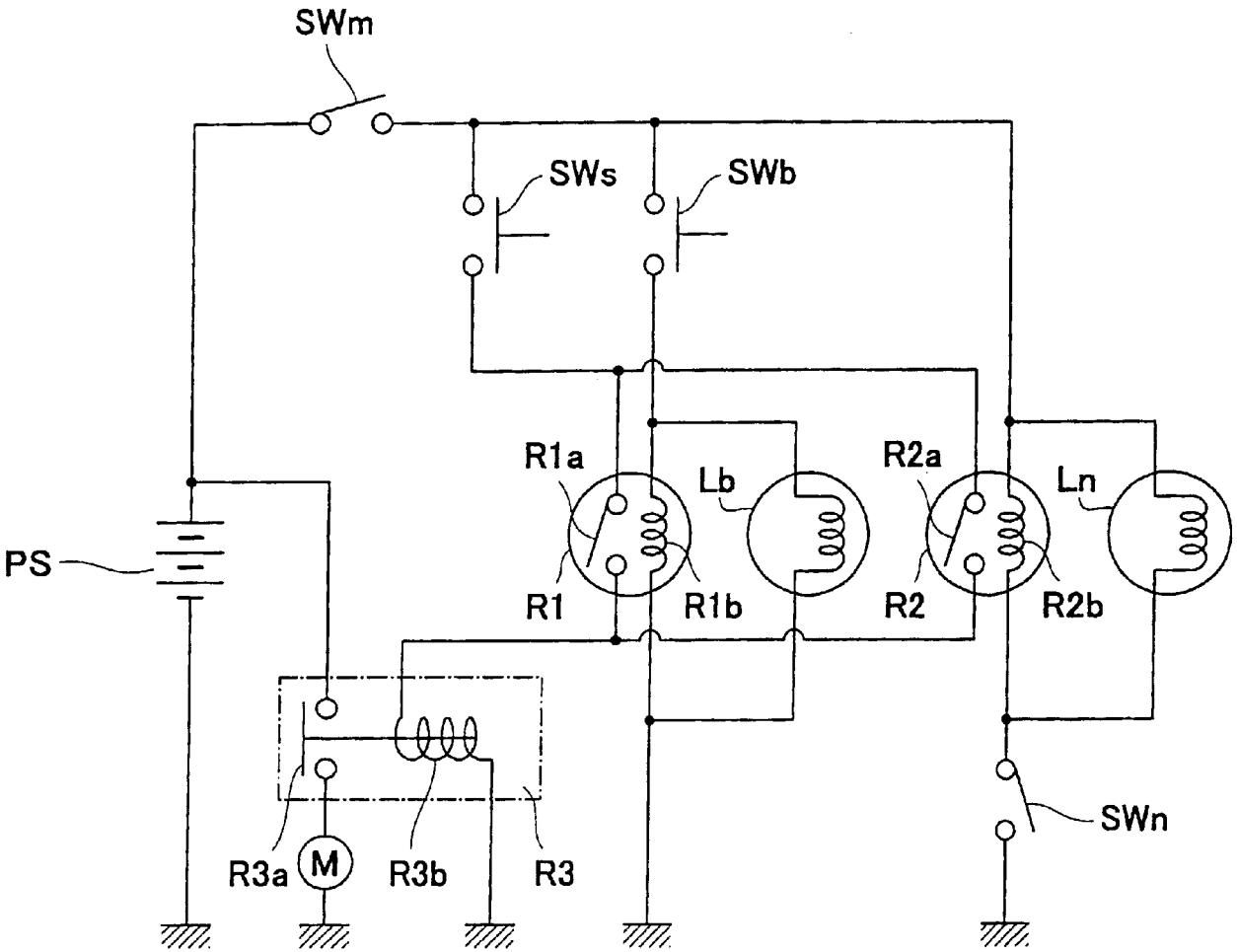
FIG. 4 is a circuit diagram showing a configuration of a starter device of the straddle-type four wheeled all terrain vehicle according to the present invention.

FIG. 4 is a circuit diagram showing a configuration of the starter device of the all terrain vehicle of this embodiment. Referring to FIG. 4, a starter motor M for driving the engine E is connected to a power supply PS through a contact R3*a* of a start relay R3, thus configuring a drive circuit. A coil portion R3*b* of the start relay R3 is connected to the power supply PS through a contact R1*a* of a first relay R1, a starter switch SWs, and a main switch SWm, and a contact R2*a* of a second relay R2 is connected in parallel with the contact R1*a* of the first relay R1, thus configuring a starter circuit.

The coil portion R1*b* of the first relay R1 is connected to the power supply PS through the brake switch SWb and the main switch SWm and a brake lamp Lb is connected in parallel with the coil portion R1*b* of the first relay R1, thus configuring a brake circuit.

A coil portion R2*b* of the second relay R2 is connected to the power supply PS through a neutral switch SWn and the main switch SWm, and further, a neutral lamp Ln is connected in parallel with the coil portion R2*b* of the second relay R2, thus configuring a neutral circuit.

The main switch SWm is a key-type switch provided at a suitable position of the vehicle's body. The rider inserts a key and rotates it toward a predetermined direction for turning on the switch SWm, or otherwise, returns it to its initial position for turning off the switch SWn. In this embodiment, the starter switch SWs is, as shown in FIG. 3, provided on a switch box SB installed at a base end portion of a left grip G of the steering handle H. The rider presses the starter switch SWs to be turned on, or otherwise releases it to be returned to its initial position and automatically turned off.

In this embodiment, the brake switch SWb is turned on when the rider operates any of the brakes FB, RB1, RB2 by a predetermined amount or more, and is returned to its initial position and automatically turned off by a force from a built-in spring upon the rider releasing the switch. The neutral switch SWn is provided at any position in an operating system of the transmission gear T and is turned on when the transmission lever L is at the neutral position.

As described above, the brake lamp Lb is lighted up when any of the brakes FB, RB1, RB2 is operated by a predetermined amount or more and the neutral lamp Ln is lighted up when the transmission lever L is at the neutral position.

In the circuit configuration of this embodiment, when the transmission lever L is at the neutral position, the neutral switch SWn is at the closed position. In this state, when the main switch SWm is closed, the neutral lamp Ln is lighted up, and simultaneously, an excitation current flows through the coil portion R2*b* of the second relay R2, thereby closing the contact R2*a*. In this state, further, when the starter switch SWs is closed, a current flows through the starter circuit and the excitation current flows through the coil portion R3*b* of the start relay R3, thereby closing the contact R3*a*, to allow a current to flow through the drive circuit. Thereby, the starter motor M is energized.

Meanwhile, when the brake switch SWb is closed in the state in which the neutral switch SWn is at the closed position, the brake lamp Lb is lighted up, and simultaneously, the excitation current flows through the coil portion R1*b* of the first relay R1, thereby closing the contact R1*a*. In this state, further, when the starter switch SWs is closed, a current flows through the starter circuit via both of the first relay R1 and the second relay R2 and the excitation current flows through the coil portion R3*b* of the start relay R3, thereby closing the contact R3*a*, to allow a current to flow through the starter circuit. Thereby, the starter motor M is energized.

Furthermore, even in the case where the transmission lever L is at any position other than the neutral position and the neutral switch SWn is placed at an open position, when the brake switch SWb is closed, the brake lamp Lb is lighted up and the excitation current flows through the coil portion R1*b* of the first relay R1, thereby closing the contact R1*a*. In this state, when the starter switch SWs is closed, the current flows through the starter circuit and the excitation current flows through the coil portion R3*b* of the start relay R3, thereby closing the contact R3*a*, to allow the current to flow through the drive circuit. Thereby, the starter motor M is energized.

Thus, since the brake circuit is not dependent on the neutral circuit in the circuit configuration of this embodiment, the starter motor M is configured to operate while the brake switch SWb is at the closed position regardless of whether the neutral switch SWn is at the open/closed position.

Moreover, in the circuit configuration of this embodiment, even when the neutral lamp Ln has burned out, the neutral circuit can continue to operate without being disconnected, because the neutral lamp Ln is connected in parallel with the coil portion R2*b* of the second relay R2.

Likewise, even when the brake lamp Lb has burned out, the brake circuit can continue to operate without being disconnected, because the brake lamp Lb is connected in parallel with the coil portion R1*b* of the first relay R1.

According to the starter device of the four wheeled all terrain vehicle according to the present invention, even when the engine of the vehicle stalls during traveling or stop, the engine can be re-started without the necessity of returning the transmission lever to its neutral position. In addition, the starter device of the present invention is highly reliable, because even when the brake lamp or the neutral lamp has burned out, the corresponding switches reliably function and in particular, the brake lamp can be lighted up and the starter circuit can be closed without a need for two contacts, i.e., the brake switch and the contact. Moreover, the straddle-type four wheeled all terrain vehicle comprising the starter device enables the rider to easily re-start the engine while griping the steering handle.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meters and bounds of the claims, or equivalence of such meters and bounds thereof are therefore intended to be embodied by the claims.

What is claimed is:

1. A starter device of a four wheeled all terrain vehicle including a starter motor operated by a power supplied from a power supply mounted in the vehicle; an engine for driving the vehicle driven by the starter motor; a transmission for transmitting a power of the engine; a neutral lamp lighted up by the power supplied from the power supply to notify a neutral state of the transmission; a brake operating means for operating a brake of the vehicle; and a brake lamp lighted up by the power supplied from the power supply to notify a brake operation of the brake operating means, the starter device comprising:

a drive circuit for connecting the starter motor to the power supply;

a start relay;

a starter circuit for connecting the start relay to the power supply through a starter switch;

a first relay;

a neutral switch provided between the starter circuit and a ground;

a brake switch provided between the starter circuit and the ground so as to be in parallel with the neutral switch; and a second relay provided in parallel with the first relay and in series with the neutral switch, wherein the starter motor is energized by at least either one of responsively closing the neutral switch to cause the neutral lamp connected to the power supply to be lighted up and to cause the second relay to be closed, when the transmission is at a neutral position, and responsively closing the brake switch to cause the brake lamp connected to the power supply to be lighted up and to cause the first relay to be closed, when the brake operating means is operated, and when the starter switch is operated to be closed to cause the start relay to be responsively closed.

2. The starter device of the four wheeled all terrain vehicle according to claim 1, wherein the brake lamp is provided in parallel with the first relay and in series with the brake switch.

3. The starter device of the four wheeled all terrain vehicle according to claim 1, wherein the neutral lamp is provided in parallel with the second relay and in series with the neutral switch.

4. A straddle-type four wheeled all terrain vehicle, comprising:

the starter device according to claim 1;

a steering handle having a grip;

a transmission lever provided at a position of the vehicle's body that is different from a position where the steering handle is provided, for operating in association with the neutral switch; and a brake operating means operating in association with the brake switch, wherein the starter switch is provided in the vicinity of the grip of the steering handle.

5. The straddle-type four wheeled all terrain vehicle according to claim 4, wherein the brake operating means is a hand brake provided in the vicinity of the grip of the steering handle.

6. The straddle-type four wheeled all terrain vehicle according to claim 4, wherein the brake operating means is a foot brake.

* * * * *